United States Patent [19]

Genevois et al.

[11] 4,284,404

[45] Aug. 18, 1981

[54] CONTINUOUS RING BAKING FURNACES OF THE HOFFMANN TYPE

[76] Inventors: Jean L. Genevois, Corso Sempione, 3, Milano; Roberto Falohi, Via Abruzzi 11, Terni; Giovanni Costantini, Viale Treviri, 147, Ascoli Piceno; Paolo Presti, Via della Balduina 133, Roma, all of Italy

[21] Appl. No.: 118,683

[22] Filed: Feb. 5, 1980

[30] Foreign Application Priority Data

Feb. 5, 1979 [IT] Italy ..... 47898 A/79

[51] Int. Cl.[3] ..... F27B 9/40

[52] U.S. Cl. ..... 432/37; 432/52; 432/192

[58] Field of Search ..... F27D/19/00; 432/36, 432/37, 52, 145, 192

[56] References Cited

FOREIGN PATENT DOCUMENTS 2505335 8/1976 Fed. Rep. of Germany ..... 432/192

2807887 8/1979 Fed. Rep. of Germany ..... 432/36

*Primary Examiner*—John J. Camby

*Attorney, Agent, or Firm*—DeLio and Montgomery

[57] ABSTRACT

An automatic control system for a continuous ring furnace, wherein the chambers and groups of chambers are operated successively in different phases of the baking cycle; the condition of certain chambers being monitored to obtain signals representing actual parameters and the signals being fed to a computer for comparison to optimum values and correction of any observed deviations therefrom.

7 Claims, 2 Drawing Figures

CONTINUOUS RING BAKING FURNACES OF THE HOFFMANN TYPE

This invention relates to an improvement in continuous ring baking furnaces of the Hoffmann type for baking and/or re-baking carbon bodies. In order to obtain products of excellent quality and uniform properties in such furnaces, it is necessary to achieve a particular thermal cycle according to which the material to be baked is brought from the ambient temperature to the one which is considered suitable for baking, according to the desired heating rate.

In the now used furnaces, however, it is practically impossible to achieve the desired heating rate, because of their function of recovering heat, i.e. in such furnaces the flue gases are used for heating the chambers placed after the chambers with burners, that is at the maximum temperature, and these furnaces are therefore subject to the inconvenience that the temperature increase is influenced not only by the conditions existing in the single pit groups, but also by those of the preceding groups.

As an example, in said furnaces, in order to control the temperature distribution is the various pit groups, the flow of the flue gases sucked by the furnace ventilator is varied by operating the "throttle and gate valves" which are provided for that purpose.

The flow valve is used, for instance, when the temperature in the group of pits in distillation arises exceedingly, due to the combustion of the volatile matters emitted by the carbon bodies to be baked.

The method applied for limiting this temperature rise is to increase the draft of the whole furnace so as to increase the gas flow through the concerned chambers.

At the same time, however, the increased draft causes the chambers with burners to be cooled, due to the increased air inlet. It is therefore necessary to give these chambers the right temperature by increasing the fueling for the burners, thus obtaining, as a consequence, a rise of the temperatures of all chambers next to the ones with burners.

Moreover, since the draft increase causes a temperature rise in the outlet gases, the temperature of the chambers in pre-heat (i.e. in pre-distillation) can reach the typical values of the distillation, with consequent increased danger of overheatings or fires in the flue duct, suction fans, abatement plants and stack.

This example shows how difficult in the now used furnaces it is to maintain the firing cycle in the pre-fixed values by operating manually the various parameters which influence the cycle and, for this reason, products of not at all satisfactory quality are obtained.

Purpose of this invention is, therefore, to supply an improved continuous ring baking furnace (Hoffmann type), which is provided with an automatic control device for controlling the temperature gradient in the various groups of chambers, this device operating actually on the whole furnace.

For a better understanding of the technical solutions composing this invention, the chambers of a Hoffmann furnace can be divided in 6 groups:

(a) group of chambers in the first pre-heat (or pre-distillation) whose temperature is between the ambient temperature and the one fit for starting the distillation of tar and pitch which are employed in the carbon bodies to be baked as binding or impregnating substances;

(b) group of chambers in distillation where, due to the combustion of the volatile matters emitted just in this stage by the carbon bodies to be baked, a great tendency to an anomalous temperature increase results.

(c) group of chambers in preparation, i.e. between the pits in distillation (b) and those with burners (d);

(d) group of chambers with burners (e) group of covered chambers in cooling (f) group of uncovered chambers in cooling.

It needs to be now added that in order to achieve a baking cycle giving baked products of high and constant quality, it is necessary to control as exactly as possible the temperature in the chambers of groups: (b) pits in distillation, (c) chambers in preparation and (d) chambers with burners. As a consequence, the furnace improved according to this invention includes a system of sensors, control devices and intervention equipments, which are placed in every group of the above chambers, allowing thus to control the chambers temperature and sending the measured values to a processor which makes the above devices and equipments start—in order to restore the pre-fixed temperature values—every time the sensors receive values which are different from those pre-fixed for these chambers.

It has to be observed that the temperature values in the group of chambers in pre-heat (group a) and those of chambers in cooling (groups e and f) are not critical and therefore it is not necessary to provide these groups of chambers with intervention equipments. At most, the chambers of group (a) can be provided with control elements allowing the baking diagrams being stored.

More particularly the system includes a central processor connected with the various sensors, devices and equipments. This system is also programmed in such a manner that the information given by the sensors can be compared with the previously stored optimum values and the intervention devices and equipments can be set going to remove the difference between the received data and the stored values, if this difference exceeds a certain percentage. These sensors, devices and equipments are for the following groups:

(1) Chambers in pre-heat or pre-distillation (group a).

These chambers are provided with only thermal control elements allowing the temperature to be measured but without any interfering.

(2) Chambers in distillation (group b).

As already said, in these chambers there is a great tendency to noteworthy, undesirable temperature increases. Therefore thermal sensors and equipments will be placed in said chambers for nebulizing a liquid cooler such as water.

(3) Chambers in preparation (group c).

Generally, in the chambers of this group the real temperature can be different, i.e. lower or higher than the programmed values. For this reason, thermal sensors have been placed in these chambers, in order to monitor such differences. Connected with these sensors there is also a control device which, while regulating the motor speed of the ventilator determining the heat gas flow, causes a rise or a reduction of the flow according to the temperature being lower or higher than its programmed values.

(4) Chambers with burners (group d).

In these chambers noteworthy variations of the temperature can result owing to the gas flow differences caused by the regulated ventilator speed or by any other reason such as, for instance: position of chambers with burners in the furnace, air-tight qualities of the furnace or the like.

Therefore, also in these chambers there will be thermal sensors combined with devices regulating the fueling of the burners so as to increase or decrease the quantity of flue gases according to the chambers temperature having to be increased or decreased.

Moreover, in the system according to this invention, a control of the equipment can also be made by means of a computer for the partial recycling of the gases, which was claimed in the Italian Pat. 49336A/76 dated May 5, 1976 by the same applicant.

In fact, this equipment needs to be controlled to avoid either a too high pressure of the recycling gas flow—i.e. a resulting pressure above zero in the first uncovered pit in cooling—determining an emission of pollutant fumes into the ambient air, or that an insufficient pressure of the gas flow—i.e. a resulting pressure under zero in the first uncovered chamber in cooling—prevents taking complete advantage of gas recycling.

In order to make this control, in the first chamber in cooling, into which air enters and immediately after which the recycling gases are let in, a suitable pressure measurer is placed for sending the pressure data to the processor. Moreover, also the motor of the fan, causing the emission of recycling gases in the furnace, will be connected with a control device, in order to regulate the fan rotation speed, this device being connected with the processor so as to be driven by it according to the signals coming from the pressure detector, whereby the motor speed is increased or decreased according to the recycling gas flow having to be increased or decreased, in order to establish the right pressure in the first uncovered chamber in cooling.

Merely for the purpose of storing the pressure data, another pressure detector is placed in the last covered chamber on top of the fumes outlet towards the flue duct.

Finally, since it is undoubtedly useful to know both the total gas flow and that of the recycling gases at every moment, in their respective ducts Venturi-nozzles are placed which measure the above mentioned flow and send the concerned signal to the main computer for storing and, on request, gives information about them.

Detailed description of the invention referring to the enclosed drawings, where:

Figure 1:
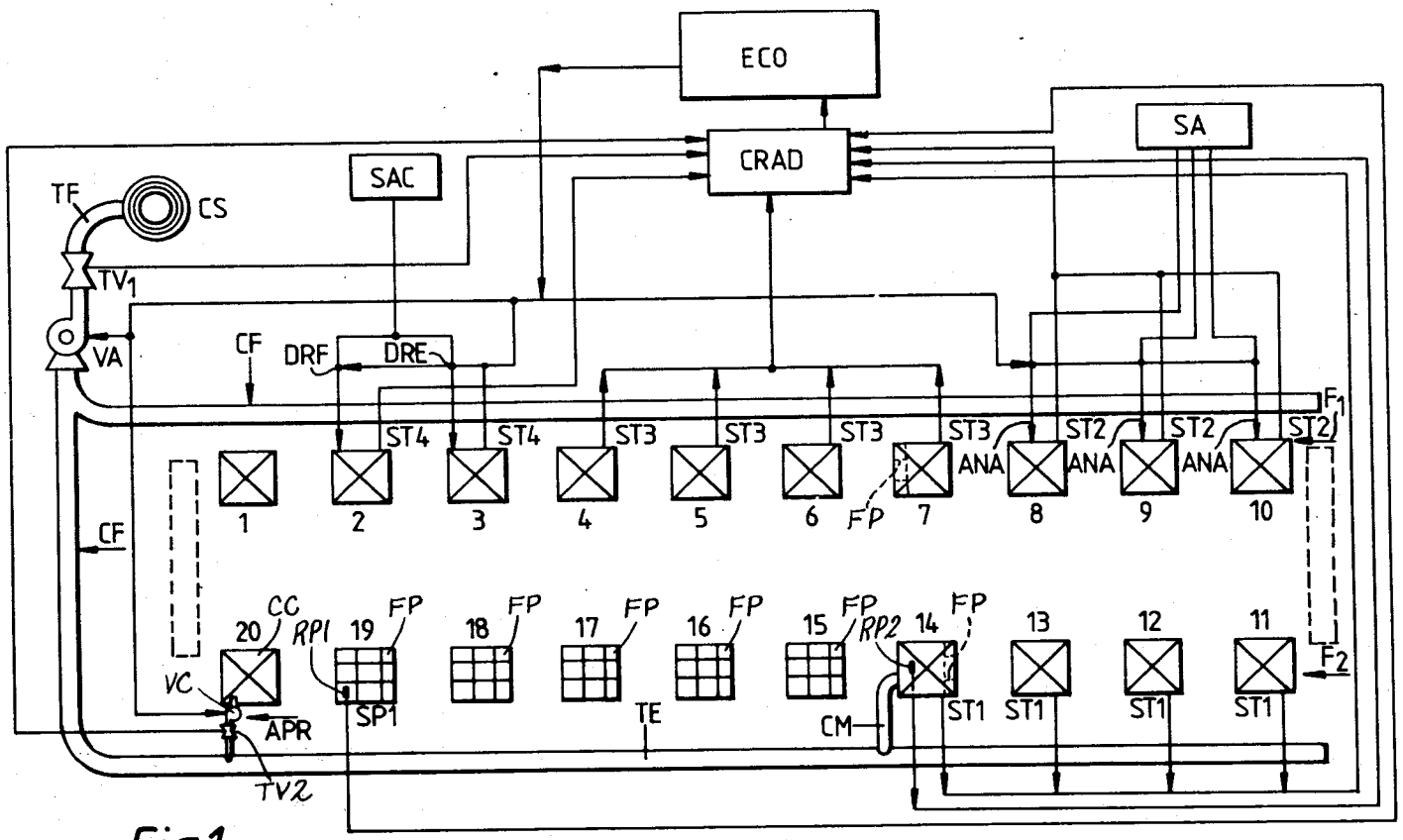
FIG. 1 is a complete schematic view of a ring furnace of the Hoffmann type provided with a system according to this invention.
Figure 2:
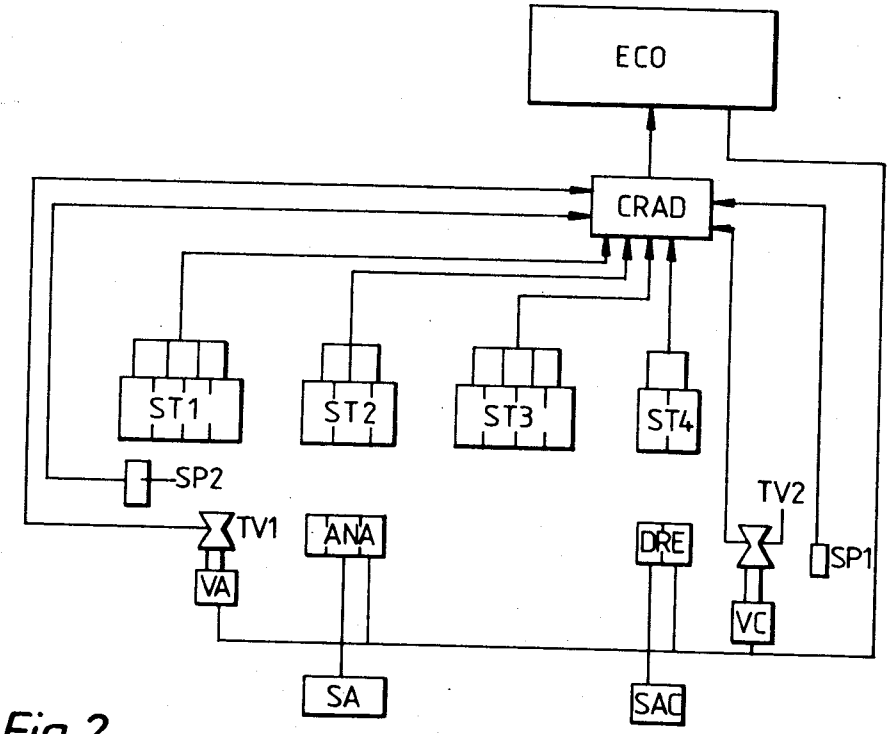
FIG. 2 is a scheme of the system according to this invention, connected with the various groups of chambers.

FIG. 1 shows a Hoffmann furnace equipped as follows: with a flue duct CF which is illustrated in the shape of a U which is placed outside the two pit rows F1 and F2 each of them having 10 chambers for total 20 chambers numbered from 1 to 20; with a suction fan VA placed before the first Venturi tube TV1 at the terminal length TF of the duct CF leading to the stack CS; with an equipment for recycling the fumes APR which is placed between the TE of the flue duct CF outside the chamber rows F2 and the first covered chamber in cooling which, according to the attached illustration, is the chamber No. 20.

Each of the chambers 1 to 20 has conventional features including a capacity to receive work pieces to be baked, a hollow wall for circulation of hot gasses, a fire pit (designated FP in certain chambers), and connections to the duct CF.

The recycling equipment comprises the cover CC placed on chamber 20, the compression VC fan placed at the end of the second Venturi tube TV2, on the minor duct connecting the cover CC with the part TE of the flue duct CF. It seems right to be reminded that this equipment works in such a way as to suck part of the flue gases which, after going in clock-wise direction through the chambers with burners (2 and 3), through the chambers in preparation (4 up to 7), through the chambers in distillation (8 up to 10) and finally through the chambers in pre-heat (11 up to 14), are let in the flue duct CF through the movable connection CM placed in correspondence with the pit 14. These flue gases are then conveyed into the chambers with burners 2 and 3 through the covered chambers in cooling 20 and 1.

As said, the system according to the invention will check the temperature and the pressure in the chambers with burners (2 and 3); in the chambers in preparation (4 up to 7), in those in distillation (8 up to 10) and in those in pre-heat (11 up to 14) for data collection; in first uncovered chamber (19); after the first chamber in cooling (20) and finally in the pit connected with the flue duct CF (14).

For this purpose, the system includes a set of processors including a central processor unit ECO and a minor data collector CRAD; a set of local detectors, including a group of thermal sensors, generally designated ST1, placed in the four chambers in pre-heat (group a); another group of thermal sensors designated ST2, placed in the three distillation chambers (group b); a third group of thermal sensors, generally designated ST3, placed in the four pits in preparation (group c); a fourth group of thermal sensors, generally designated ST4, placed in the two chambers with burners (group d); a pressure detector RP1 placed in the first uncovered chamber in cooling (pit No. 19); a pressure detector RP2 placed in the last chamber before the fumes outlet (pit No. 14); a set of devices and intervention equipments consisting of:

I. Three equipments for water nebulization, generally designated ANA, one for each pit of group (b);

II. A circuit for regulating the speed of rotation of an electric motor, combined with the VA suction fan motor, placed on the final length TF of the flue duct CF before reaching the stack CS;

III. Two regulating devices designated DRE regulating the fueling of the burners (not shown) placed in the chambers with burners;

IV. A second circuit for regulating the speed of an electric motor operating the fan motor VC, included in the APR equipment for re-cycling the fumes, which is placed in the pipe outgoing from the cover CC which connects the chamber No. 20 with the flue duct CF.

A. Any increase found by the ST2 thermal sensor in the temperature in comparison with the temperature which is considered most suitable for the chambers in distillation (group b) being this temperature stored in the ECO processor is communicated to the CRAD (minor computer for data collection) and then to the ECO processor which makes the equipments intervene for nebulizing the water. These equipments, named ANA, are filled with water by a tank SA, whereby nebulized water is let in the concerned chambers till the optimum temperature is achieved.

B. Any variation of temperature in the chambers of group (c), i.e. in those chambers in preparation, in comparison with the best temperature for these chambers which is stored in the ECO processor, is revealed by the thermal sensor ST3 and then communicated to CRAD and then to the ECO processor which intervenes on the first circuit for regulating the motor speed connected with the suction fan VA, so that the motor speed is increased, whereby also the flow of heat gases is increased if the measured temperature is lower than the stored one, and the motor speed is decreased, whereby also the flow decreased, if the measured temperature is higher than the stored one.

C. Any increase or decrease stored in the ECO processor in comparison with the optimum temperature for the chambers with burners (group d) and that which has been revealed by the ST4 sensor and communicated to the CRAD processor and then to the ECO processor, will make the ECO processor intervene on the devices regulating the fueling, which are placed in the pipes connecting the burners (not shown) placed in the chambers with burners with the fuel methane (gas, oil and the like) source, said SAC, whereby the fuel quantity is increased for lowerer temperature values and decreased for too high values.

D. Any variation, in comparison with the atmospheric pressure, of the pressure in the first uncovered chamber in cooling (which is No. 19) revealed by the first pressure sensor SP1 and given to the CRAD computer and by this to the ECO processor, makes the latter intervene on the second circuit controlling the rotation speed included in the system according to this invention which is combined with the motor of the VC fan included in the APR equipment. The intervention shall be done in such a way that the motor speed will be decreased as well as the flow of the gases sucked by the VC fan and let in the chamber 20 (which, as known, is connected with the chamber No. 19), if the sensor SP1 in the chamber 19 at the outlet of the ducts connecting with the chamber No. 20, reveals a higher pressure than the atmospheric pressure, and that the motor speed will be increased if the sensor reveals a lower pressure than the atmospheric pressure. This is necessary because a higher pressure in the chamber 19 than the atmospheric pressure shows that the action of the VC fan is excessive and the sucked fumes, which are very pollutant, are sent besides into chamber 1 also into chamber 19 and then into the air, while a lower pressure than the atmospheric pressure shows that the action of the VC fan is insufficient for recycling the gases.

E. Both Venturi tubes TV1 and TV2 are connected with the CRAD computer and then with the ECO processor, so that the latter can receive uninterruptedly the values of the flow in the ducts TF and in the pipe connecting the cover CC with the length TE so that these values can be stored and obtained on request at any moment.

F. Finally, as already mentioned in E, the values revealed by the thermal sensors ST1 in the chambers in pre-heat and by the pressure sensor SP2 are communicated to the ECO processor where they are stored in order to collect and store continuously all the data concerning the running of the furnace.

More particularly, concerning the function of the pressure sensor SP2, since its data are merely stored in the ECO processor, they are compared in it continuously with the data given by the SP1 (however, when these data are different from zero, they make the processor intervene—as previously mentioned—in such a manner that—if wished—it is possible to obtain the pressure difference between chambers 14 and 19 from the ECO processor at any moment.

It seems now suitable to mention that all devices for measuring the temperature and the pressure, the intervention equipments like ANA (i.e. water nebulizer), the DRE devices for regulating the fueling of the burners, and their connections with the computer and the processor shall have to be movable units because—as the experts in this field already know—the various phases move in the furnace as soon as the products in the various chambers get at the end of the baking cycle; according to the illustrated example, the various phases move in clockwise direction which is the same as that of the hot gases inside the kiln. Obviously, the TV1 Venturi tube and the VA suction fan are set up permanently in the length FT of the flue duct. Also permanently placed are the detector connected with them and the control devices and their connections with the CRAD computer and the ECO processor which are connected with each other through asynchronous serial lines.

On the contrary, the TV2 Venturi tube and the TVC pressure fan with its motor speed control device—which, together with the CC cover, form the APR equipment for recycling the fumes—move along the furnace for this reason suitable movable connections shall have to be set up.

Concerning the circuits controlling the rotation speed of both the electric motors operating the VA and VC fans, they will be preferably well known electronic control devices, although any other media suitable for varying this speed can be used according to this invention.

Moreover, the experts in this field will understand that the system according to this invention, provided with the suitable variations and duplications of the various elements which are part of said system, can also be applied to ring furnaces having greater sizes and a nearly double number of chambers and where there are two groups of chambers with burners simultaneously, two groups of pits in preparation and so on.

What we claim is:

1. In combination with a continuous ring furnace for baking and rebaking of carbon bodies, said furnace comprising a plurality of chambers arranged in a continuous ring, each chamber including a capacity for receiving bodies to be heated and a separate fire-pit adjacent said capacity, the furnace comprising further a flue duct operatively connected to each chamber and provided with a suction fan and an outlet stack connected to the flue duct, the operation of the furnace as a whole being characterized by the simultaneous operation of phased adjacent pairs of chambers wherein (a) at least one pair of chambers is in pre-heat phase, (b) at least one pair of chambers is in distillation phase, (c) at least one pair of chambers is in preparation, (d) at least one pair of chambers is provided with fuel burners, (e) at least one pair of chambers is in cooling phase, and (f) at least one pair of chambers is uncovered and provided with equipment for recycling of fumes by means of a pressure fan, the improvement which includes a coordinated computerized data collection and processing system for measurement, control, and regulation of the temperature and the gas flow in groups of chambers and single chambers in a group, which system comprises a thermal sensor in each chamber of groups (a), (b), (c), and (d);

a first pressure sensor in the last chamber of group (a) which is connected to said flue duct;

another pressure sensor in the first chamber of group (f) adjacent to the last chamber of group (e), which chamber is also provided with said recycling equipment;

a first means placed in the flue duct between said suction fan and the stack for measuring the gas flow;

a second means for measuring the gas flow placed in the recycling equipment;

a first means for regulating the speed of an electric motor operatively connected to the suction fan motor;

a second means for regulating the speed of an electric motor operatively connected to the motor of the recycling pressure fan;

means in each chamber of group (b) for lowering the temperature; and valves adapted to regulate the flow of fuel to the burners.

2. The ring furnace control system according to claim 1 which includes a minor computer for data collecting and a central processor, asynchronous serial lines connecting said computer and collector, lines connecting the computer to all said temperature and pressure sensing means and to the flow measurement means, the central processor being adapted to store pre-fixed temperature and pressure values, corresponding to optimum operating conditions of the furnace, and to be controlled by said temperature lowering means, the central processor being connected also to the fuel regulating valves and to the first and second motor speed regulating means, whereby the operating temperature and pressure valves are made to correspond to the stored values whenever the former are found to deviate from the latter.

3. The ring furnace control system according to claim 2, wherein each pressure sensor comprises a Venturi tube fully enclosed within a respective duct.

4. The ring furnace control system according to claim 2, wherein each motor speed regulating means comprises an electronic control circuit.

5. The ring furnace control system according to claim 2, wherein the temperature lowering means are constituted by nebulizing nozzles supplied from a suitable source with a liquid coolant, said last named means including valve controls connected with the central processor.

6. The ring furnace control system according to claim 2, wherein the fuel supplied to the burners is gas.

7. The ring furnace control system according to claim 2, wherein the fuel supplied to the burners is a liquid.

* * * * *

UNITED STATES PATENT AND TRADEMARK OFFICE

CERTIFICATE OF CORRECTION

PATENT NO. : 4,284,404

DATED : August 18, 1981

INVENTOR(S) : Jean L. Genevois et al

It is certified that error appears in the above-identified patent and that said Letters Patent are hereby corrected as shown below:

Col. 2, line 7, "pits" should be changed to read --chambers--

Col. 2, line 15, "pits" should be changed to read --chambers--

Col. 4, line 38, "pit" should be changed to read --chamber--

Col. 6, line 40, "pits" should be changed to read --chambers--

Signed and Sealed this

Tenth Day of November 1981

[SEAL]

*Attest:*

GERALD J. MOSSINGHOFF

*Attesting Officer*

*Commissioner of Patents and Trademarks*